US008051948B2

(12) United States Patent
Geyer, III

(10) Patent No.: US 8,051,948 B2
(45) Date of Patent: Nov. 8, 2011

(54) SILENCER APPARATUS WITH DISPOSABLE SILENCER CARTRIDGE UNIT

(75) Inventor: Robert E. Geyer, III, Schererville, IN (US)

(73) Assignee: Endustra Filter Manufacturers, Schererville, IN (US)

( * ) Notice: Subject to any disclaimer, the term of this patent is extended or adjusted under 35 U.S.C. 154(b) by 0 days.

(21) Appl. No.: 12/973,263

(22) Filed: Dec. 20, 2010

(65) Prior Publication Data

US 2011/0088966 A1 Apr. 21, 2011

Related U.S. Application Data

(62) Division of application No. 12/030,430, filed on Feb. 13, 2008, now Pat. No. 7,878,299.

(51) Int. Cl.
*F01N 13/18* (2010.01)

(52) U.S. Cl. ..... 181/243; 181/229

(58) Field of Classification Search ..... 181/229, 181/230, 243

See application file for complete search history.

(56) References Cited

U.S. PATENT DOCUMENTS

| | | | | | |
|---|---|---|---|---|---|
| 1,968,312 | A * | 7/1934 | Rensink | 96/383 |
| 2,050,581 | A * | 8/1936 | Orem | 96/383 |
| 2,749,998 | A * | 6/1956 | Brown et al. | 181/229 |
| 3,226,917 | A * | 1/1966 | Donovan et al. | 96/380 |
| 3,508,383 | A * | 4/1970 | Buonpastore et al. | 55/337 |
| 3,563,338 | A * | 2/1971 | Rader | 181/243 |
| 4,065,276 | A * | 12/1977 | Nakaya et al. | 96/380 |
| 4,278,147 | A * | 7/1981 | Watanabe et al. | 181/256 |
| 4,314,832 | A * | 2/1982 | Fox | 55/482 |
| 4,408,679 | A * | 10/1983 | Littrell | 181/243 |
| 4,424,883 | A * | 1/1984 | Musiani | 181/258 |
| 5,434,374 | A * | 7/1995 | Hsueh | 181/228 |
| 6,641,637 | B2 * | 11/2003 | Kallsen et al. | 55/385.3 |
| 2005/0150716 | A1 * | 7/2005 | Nasuno et al. | 181/231 |
| 2006/0288676 | A1 * | 12/2006 | Geyer | 55/498 |

* cited by examiner

*Primary Examiner* — Jeremy Luks

(74) *Attorney, Agent, or Firm* — Hartman & Hartman, P.C.; Gary M. Hartman; Domenica N. S. Hartman

(57) ABSTRACT

A silencer apparatus for attenuating noise in gas flow systems. The apparatus generally includes a housing having an interior cavity and a gas flow inlet and outlet that are adapted to be connected to a passage such that a gas flowing through the passage enters and exits the cavity of the housing through the inlet and outlet, respectively. A silencer cartridge unit is removably disposed within the interior cavity of the housing and defines a gas flow path fluidically connected to the inlet and outlet of the housing. The silencer cartridge unit has at least one sound-attenuating element that surrounds the gas flow path. The housing is further equipped with a closure that sealingly closes a portion of the housing, and is releasable from the housing to provide an access opening through which the silencer cartridge unit can be removed. The apparatus can also be adapted to include a filtration medium.

20 Claims, 5 Drawing Sheets

SILENCER APPARATUS WITH DISPOSABLE SILENCER CARTRIDGE UNIT

CROSS REFERENCE TO RELATED APPLICATIONS

This is a division patent application of co-pending U.S. patent application Ser. No. 12/030,430, filed Feb. 12, 2008. The contents of this prior application are incorporated herein by reference.

BACKGROUND OF THE INVENTION

The present invention generally relates to equipment for attenuating noise in gas flow systems, including blowers, compressors, turbines, etc. More particularly, the present invention relates to silencer equipment containing a noise attenuation unit that can be removed and replaced as a unit to maintain the performance of the silencer equipment and, by disposing of the noise attenuation unit at the end of its useful life, protect downstream blowers, compressors, turbines, etc., from damage. The present invention can be applied in conjunction with all methods of attenuating noise caused by inlet or outlet gas streams.

Certain equipment capable of noise/sound attenuation in gas (typically air) flow streams are commonly referred to as silencers in the art. Common sources of undesirable noise levels include, for example, blowers, compressors, turbines, etc., in a variety of installations, including manufacturing plants, bottling plants, laboratories, industrial plants, power generation facilities, waste water treatment plants, etc. Generally, a flowing gas stream through which undesirable noise is propagated from an upstream or downstream source is passed through a flow passage within a silencer, where the noise is attenuated using various means that are generally categorized as absorptive or reactive (also referred to as chambered). Absorptive silencers typically make use of barrier layers, typically steel or other materials known to be effective in interrupting the transmission of sound energy combined with layers of fibrous or cellular (fabric or foam) absorptive material that surrounds the flow passage and attenuates sound by transferring the energy of sound waves to the absorptive material, generally by converting the sound wave energy within the gas to vibrational and/or thermal energy within the absorptive material. Reactive silencers typically make use of pulse chambers connected to the flow passage, annular noise attenuation tubes, or axially-disposed noise attenuation tubes, into which the sound waves are conducted and suppressed. Hybrid silencers also exist that make use of both absorptive and reactive techniques.

Silencers are typically manufactured as dedicated standalone units that are installed inline in a conduit, duct, pipe, or other passage through which the gas stream flows. Examples of conventional silencers include those sold by Universal Silencer of the Fleetguard/Nelson Company, Stoddard Silencer, and Burgess-Manning of Nitram Energy, Inc. Universal Silencer describes silencers in currently existing product instructional materials as "complete weldments or permanently assembled having no replaceable parts." For air inlet applications, silencers are often used in combination with filters, though again typically as a standalone unit that is often connected between the filter housing and the noise source. However, integrated filter-silencer units are also commercially available, examples of which include the TRIVENT® Series P09 filter silencer manufactured by Endustra Filter Manufacturers, Inc. In a filter-silencer such as the Series P09, the silencer comprises a reactive chamber that forms an integral and permanent part of the filter housing, usually though not necessarily located immediately downstream of the filter element. The filter housing is configured so that the filter element is accessible for removal and replacement, but the components that make up the silencer are not as these components are, as in the aforementioned Universal Silencers, not removable or replaceable. Other commonly available integrated filter-silencers, such as those manufactured by several companies, among them Solberg Manufacturing, include reactive inlet tubes coupled with an absorptive silencer situated downstream or nested within the filter element. This reactive-absorptive filter silencer is again designed to provide access for filter element changes, but the silencer itself is an integral and permanent fixture of the housing, and is not intended to be removed or replaced.

A problem encountered with silencers is the potential damage that can occur downstream as a result of degradation of the silencer components. For example, common dedicated silencers have an exterior primed surface and are designed to handle relatively moisture-free air. However, in virtually all industrial applications, intake air or gas is ambient and therefore only as dry as the relative humidity, and the compression of air and gases creates condensation. The resulting moisture laden air attacks and corrodes the interior surfaces of the silencers. Because silencers are typically downstream of the filter element, the resulting decay of the interior surfaces, as well as the absorptive materials, causes pieces of metal, scale, fabric, foam, etc., to be drawn into the machinery, and can and does cause permanent damage to the equipment. Dedicated reactive-absorptive filter silencers, in which the absorptive silencer unit is permanently located on the inside of or downstream of the filter element, pose the same problem. Even in situations where galvanized steel or stainless steel is employed to inhibit corrosion, these materials do not deter the decay or erosion of the absorptive material or foam, which accumulate moisture, dirt, and oils that have bypassed the filter element or have been transferred during filter changes or neglect. As a result, the absorptive material breaks down and becomes free to enter the equipment inlets, where they can and do cause permanent damage.

BRIEF DESCRIPTION OF THE INVENTION

The present invention provides a silencer apparatus for attenuating noise in gas flow systems that contain a blower, compressor, turbine, or other source of noise that tends to propagate through gas compression or redirection. The silencer apparatus generally includes a housing having an interior cavity and a gas flow inlet and outlet that are adapted to be connected to a passage such that a gas flowing through the passage enters and exits the interior cavity of the housing through the inlet and outlet, respectively. A silencer cartridge unit is removably disposed within the interior cavity of the housing as a discrete and unitary component. The cartridge unit defines a gas flow path fluidically connected to the inlet and outlet of the housing, and comprises at least one sound-attenuating means, such as an absorptive, noise barrier or reactive element, that surrounds or interrupts the gas flow path as necessary to accomplish noise attenuation in the gas flow path. The housing is further equipped with a closure that sealingly closes a portion of the housing. The closure is releasable from the housing so as to provide an access opening in the housing through which the silencer cartridge unit in its entirety can be removed without dismantling or damaging the silencer cartridge unit.

The silencer apparatus can also be adapted to include a filtration medium. For example, the silencer apparatus may include a separate filtration unit with a filtration medium enclosed therein, in which case the housing and filtration unit are coupled together so that gas flowing through the housing also flows through the filtration unit and the filtration medium. Alternatively, the filtration medium may be a component of the housing, in which case the silencer cartridge unit may be surrounded by the filtration medium. In either case, both the filtration unit and the silencer cartridge unit may be removed and disposed of when their useful lifespan has been expended.

In view of the above, the silencer cartridge unit is adapted to be removed and replaced as a unitary discrete assembly from the housing without dismantling or damaging the silencer cartridge unit, and without damaging or dismantling the housing other than releasing or removing the closure. As such, the silencer apparatus is configured to allow the silencer cartridge unit to be removed, inspected, and then either cleaned and reinstalled or discarded and replaced with a second silencer cartridge unit of the same or different type. With this capability, the silencer apparatus can be used in a manner that greatly reduces the risk of damage to downstream components. In particular, the invention allows for and rightly assumes that the components of the silencer cartridge unit will inherently corrode and break down over time. To avoid pieces of metal, scale, fabric, foam, etc., from being drawn into downstream machinery, the silencer cartridge unit can be periodically removed, inspected, cleaned, and replaced as may be necessary. Further, and importantly, when its useful life has been fully exploited, the unit can be removed, disposed of, and replaced. The disposability feature, combined with the absorptive material being provided within a discrete cartridge rather than a permanent member of a welded structure, is a key aspect of the invention.

Other objects and advantages of this invention will be better appreciated from the following detailed description.

DETAILED DESCRIPTION OF THE INVENTION

FIGS. 1 through 11 depict various embodiments of silencer apparatuses within the scope of the invention. The apparatuses find use for silencing noise generated by a variety of sources, including blower, compressors, turbines, and other sources of noise that propagates through the gas being worked on. The invention is particularly well suited for intakes of single and multistage axial, centrifugal, and reciprocating compressors and single-stage centrifugal blowers (turbines), multistage blowers, industrial fans, pressure blowers, and positive displacement blowers of types used in equipment found in manufacturing plants, laboratories, industrial plants, power generation facilities, etc. While the invention will be described in particular reference to silencing noise within air flow systems, the invention can be employed to attenuate noise in a wide variety of gases for various applications. As such, the term "air" will typically be used in reference to atmospheric air, though the principles of this invention and the apparatuses themselves apply to essentially any flowing gas over wide ranges of pressures and temperatures.

Figure 1:
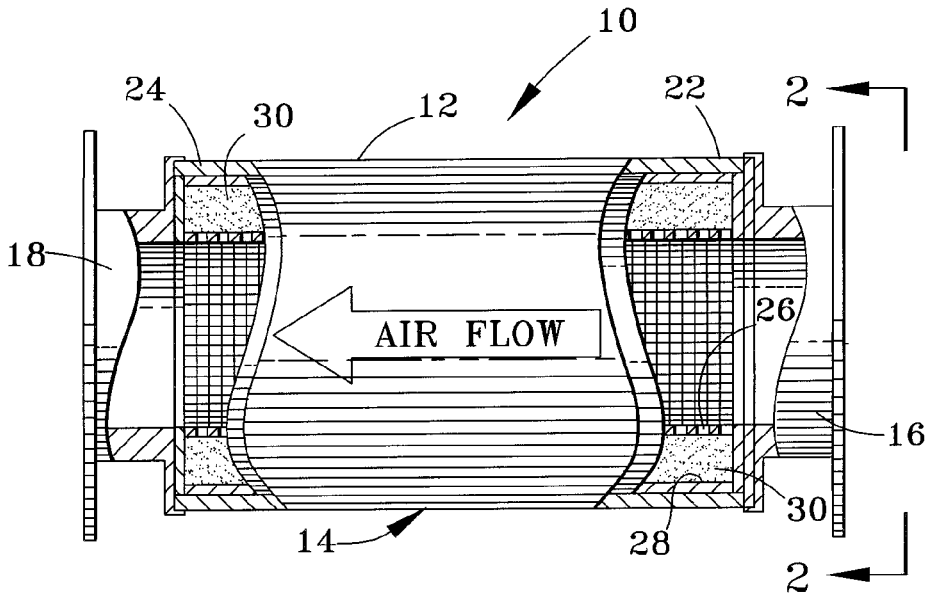
FIGS. 1 and 2 show, respectively, side and end views of a silencer apparatus in accordance with a first embodiment of this invention, with the side view showing the interior of the apparatus exposed to reveal a removable and disposable silencer cartridge unit.
Figure 2:
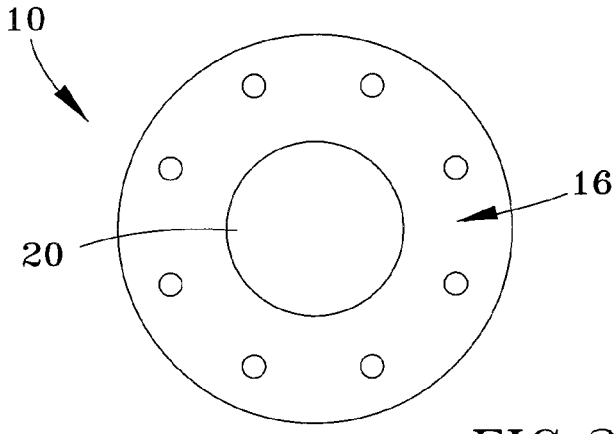
Figure 3:
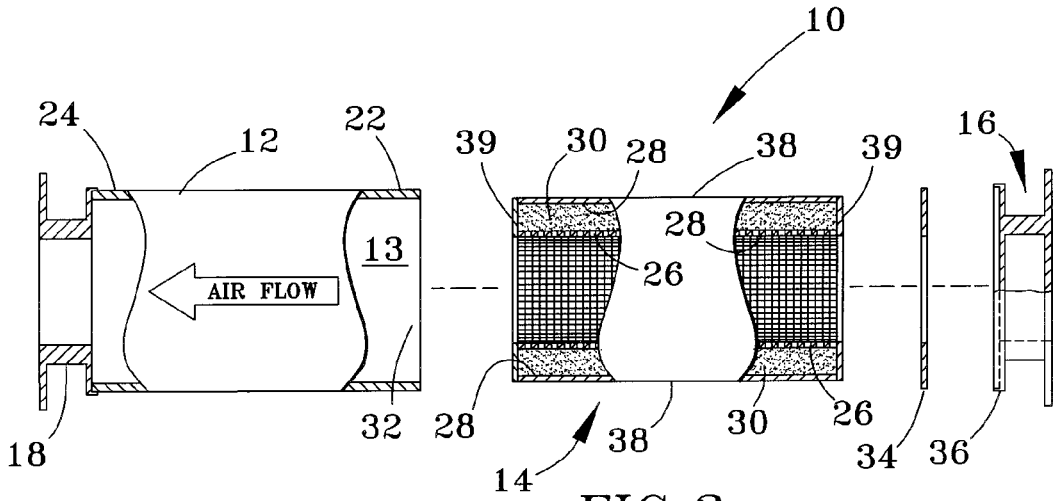
FIG. 3 is a cross-sectional exploded view of the silencer apparatus of FIGS. 1 and 2, with a closure end of the apparatus removed to provide an access opening to the silencer cartridge unit within.

With reference to FIGS. 1 through 3, a silencer apparatus 10 is shown as comprising a tubular-shaped silencer housing 12 that surrounds and encloses a silencer cartridge unit 14, an inlet 16 located at one end 22 of the housing 12, and an outlet 18 located at an opposite end 24 of the housing 12. The housing 12 is depicted as having a unitary construction, though various other constructions are possible. The housing 12 coaxially positions and orients the silencer cartridge unit 14 within its interior cavity 13 (FIG. 3) in a manner that encloses, seals, and protects the silencer cartridge unit 14 while also promoting the aerodynamic flow of air through the housing 12 and unit 14. As will become evident from the following, the silencer housing 12 and silencer cartridge unit 14 are also configured to simplify the procedure for removing and replacing the silencer cartridge unit 14. The inlet and outlet 16 and 18 are shown as comprising pipe sections terminating with flanges that enable the apparatus 10 to be connected to a conduit, duct, pipe, or other passage (not shown) through which the air stream flows. Alternatively, other types of connections could be used, including but not limited to NPT connections. As understood in the art, the housing 12 is sized to accommodate the gas flow for a given application. The length of the housing 12 can vary widely, depending on the particular application. For environmental resistance, the housing 12, silencer cartridge unit 14, inlet 16, outlet 18 are preferably formed of corrosion-resistant materials such as a stainless steel, aluminum alloy, or plastic, and/or coated with a corrosion-resistant coating (e.g., paint or galvanized).

The silencer apparatus 10 and its components are configured and sized relative to each other to provide for a flow path 20 through the silencer apparatus 10 that does not significantly resist air flow. In its simplest form, the silencer cartridge unit 14 has a tubular form (as shown) corresponding to the tubular shape of the silencer housing 12, the flow path 20 within the silencer cartridge unit 14 is substantially coaxial with portions of the flow path 20 within the inlet and outlet 16 and 18, and the portion of the flow path 20 within the silencer cartridge unit 14 is substantially equal in cross-sectional area to the portions of the flow path 20 within the inlet and outlet 16 and 18 such that the flow path 20 has a substantially constant cross-sectional area through the apparatus 10, as evident from FIG. 3. However, variants are foreseeable. As also evident from FIGS. 1 through 3, the silencer cartridge unit 14 generally has a tubular shape, with a tubular-shaped core wall 26 that is at least semipermeable to air. A tubular-shaped outer wall 38 surrounds the core wall 26, and the ends of the unit 14 are closed with end walls 39 to define an annular-shaped enclosure 28. The core wall 26 circumferentially surrounds the flow path 20, and in turn is circumferentially surrounded by an absorptive media 30 that preferably fills the entire annular enclosure 28.

In combination, the silencer housing 12, core wall 26, enclosure 28, absorptive media 30, and optionally the outer wall 38 are intended to provide a desired noise attenuation effect. The housing 12 acts as a noise barrier, and therefore must be formed of an impermeable material (such as a steel, plastic, etc.) to form an airtight seal surrounding the silencer cartridge unit 14. The outer wall 38 of the silencer cartridge unit 14 does not need to be impermeable, and may even be omitted, as long as the unit 14 is installed in an appropriately-configured housing 12 (as shown in FIGS. 1 and 2) that is air-impermeable and forms an airtight seal around the unit 14. Nonetheless, improved noise attenuation can be achieved by forming the unit 14 to include the outer wall 38 and form the wall 38 of an impermeable material, thus adding an additional noise barrier. The core wall 26 of the silencer cartridge unit 14 must be permeable or at least semipermeable, such as a result of being formed of perforated or expanded metal or plastic. Sound waves are conducted through openings in the core wall 26 and into the enclosure 28. The absorptive media 30 within the enclosure 28 serves as an absorptive silencer, and is preferably in the form of a consolidated mass that fills the enclosure 28. The absorptive media 30 absorbs and converts the sound energy that has entered the enclosure 28 into thermal energy, and sound waves that are not converted are interrupted when they encounter the outer wall 38 of the silencer cartridge unit 14 (if the outer wall 38 is present and impermeable) or the silencer housing 12 (if the outer wall 38 is not present or present but permeable). The determination of a suitable opening cross-sectional area for a given application is within the skill of those knowledgeable in the art, and will vary widely based on the amount of noise attenuation desired in a given application. Suitable materials for the absorptive media 30 are also well known to those skilled in the art, with fibrous glass, polyester, polyurethane foam, and other materials being widely used as they are durable and nonreactive with air. The length and radial width of the enclosure 28 are shown as being determined by the housing 12, inlet 16, outlet 18, core wall 26, and optional outer wall 38, all of which can be appropriately sized to achieve a desired attenuation effect for a given application. Chambers within the enclosure 28 are also foreseeable, as are other types of noise attenuators, absorbers, barriers, and interrupters.

The inlet 16 is represented in FIG. 3 as part of a removable closure of the silencer housing 12, which when removed provides an access opening 32 whose diameter is essentially the same as the interior of the housing 12 that accommodates the silencer cartridge unit 14, and therefore through which the entire silencer cartridge unit 14 can be removed from the silencer apparatus 10. An outer rim 36 of the inlet 16 can be clamped or otherwise releasably secured to the housing 12 in any suitable manner, with the result that together the rim 36 and its inlet 16 define a removable closure for the housing 12. The apparatus 10 is preferably a gas-tight assembly, and as such a ring-shaped gasket or sealant 34 is preferably provided to seal the rim 36 to the end 22 of the housing 12. Suitable materials for the sealant 34 will depend on the particular gas being handled, as well as the temperature and pressure of the gas. Because only one end of the silencer housing 12 is required to be removable so as to permit removal of the silencer cartridge unit 14, the outlet 18 can be permanently attached to the housing 12, such as by welding, crimping, etc., again with the desire of forming a gas-tight connection. It is foreseeable that the outlet 18 could be adapted for removal instead of the inlet 16, or both the inlet 16 and outlet 18 could be removable so that the silencer cartridge unit 14 can be removed from either end 22 and 24 of the housing 12.

The silencer cartridge unit 14, including its core wall 26, absorptive media 30, outer wall 38 and end walls 39, is a unit separate from the silencer housing 12 as a result of the core wall 26, enclosure 28, absorptive media 30, outer wall 38 and end walls 39 not being secured to the housing 12. As such, the housing 12 can be installed as an essentially permanent component of the air flow system in which it is used, whereas the silencer cartridge unit 14 can be manufactured as a disposable unit and simply replaced when its attenuation properties or overall condition degrades, as may result from wear, damage or accumulation of debris and particles from the air stream, aging, corrosion, scaling, and decomposition from weathering and corrosive agents in the air stream, etc., none of which is visible or otherwise readily apparent from the exterior of the silencer housing 12. The silencer cartridge unit 14 can be easily removed and inspected on a regular schedule, and either refurbished or replaced before such degradation poses a risk to equipment and processes downstream of the unit 14. As such, the silencer cartridge unit 14 is well suited for use under conditions that would be too severe or otherwise too quickly degrade the performance of a conventional silencer whose noise suppression components are integral and cannot be removed from their enclosure without cutting or otherwise damaging the enclosure. It is also foreseeable that the core wall 26 and absorptive media 30 could be formed of materials that are less expensive than those typically required for silencers, so as to provide for a low-cost silencer that can be routinely replaced with minimal impact on maintenance costs.

Figure 4:
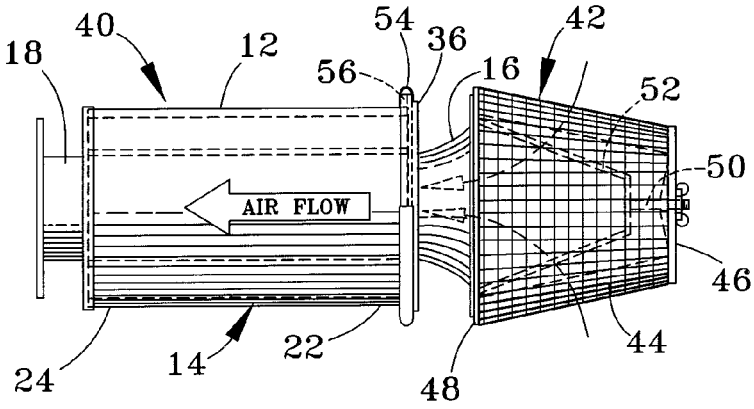
FIGS. 4, 6, and 8 represent three alternative configurations for the silencer apparatus of FIG. 1, in which a separate filtration unit is attached to the closure end of the apparatus.
Figure 5:
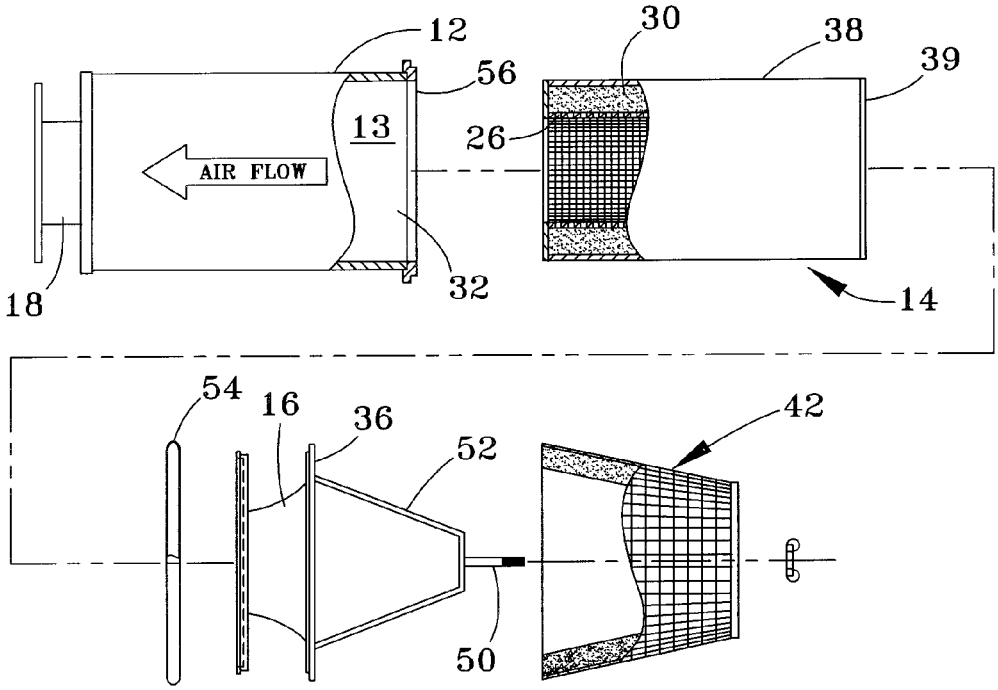
FIGS. 5, 7, and 9 are cross-sectional exploded views of the silencer apparatuses of FIGS. 4, 6, and 8, respectively.
Figure 6:
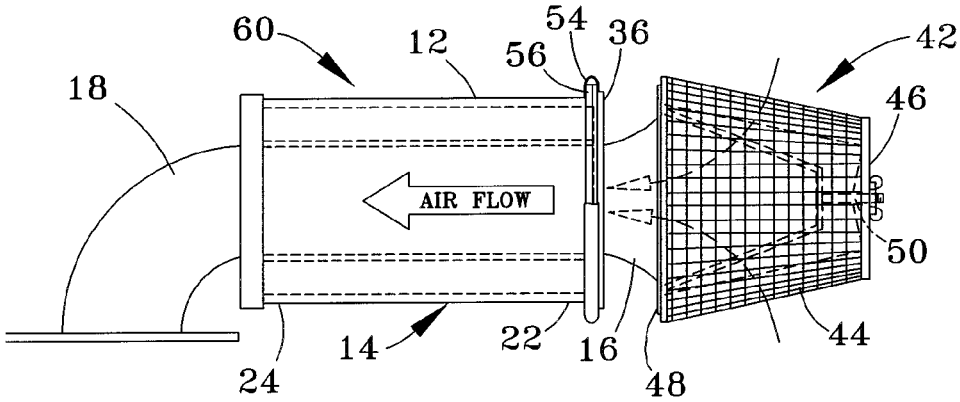
Figure 7:
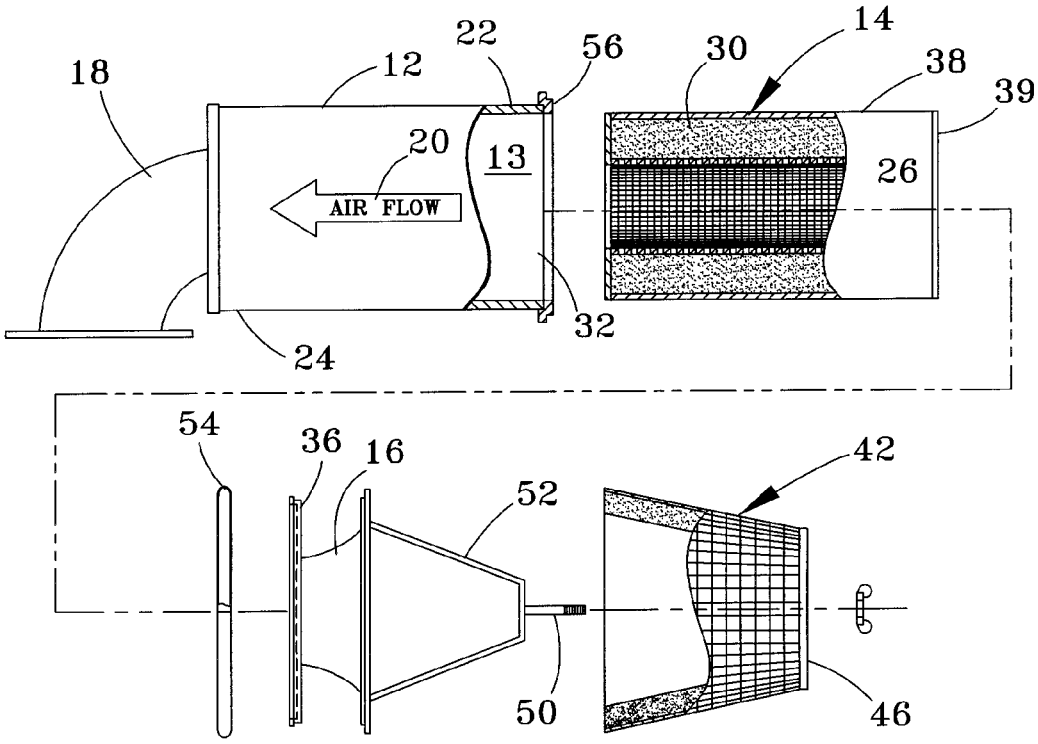

FIGS. 4 and 5 represent an apparatus 40 similar to that of FIGS. 1 through 3, but with the inclusion of a filtration unit 42 coupled to the inlet 16 of the silencer housing 12. (In the Figures, consistent reference numbers are used to identify functionally similar structures.) The preferred air flow path 20 through the apparatus 40 is indicated as being through the filtration unit 42 and then through the removable silencer cartridge unit 14 within the silencer housing 12, which may be connected at its outlet 18 to an air flow system containing a source of noise that propagates through the air flow to the apparatus 40. In this sense, the filtration unit 42 may be referred to as an air/gas intake or inlet filter, and the apparatus 40 may be referred to as a filter-silencer. The rim 36 of the inlet 16 is represented in FIG. 4 as being clamped with a ring 54 to a flange 56 at the end 22 of the housing 12, such that together the rim 36 and its inlet 16 define a removable closure for the housing 12. The inlet 16 is further represented in FIGS. 4 and 5 as having a pipe section (venturi) with a generally arcuate shape that provides a smooth transition from the inner diameter of the core wall 26 to the inner diameter of a filtration medium 44 within the filtration unit 42. The filtration medium 44 may be, for example, a pleated filtration membrane secured between two plates 46 and 48. The plate 46 is shown secured with a fastener system 50 to a bracket 52 attached to the other plate 48, though other configurations and assembly techniques are foreseeable. Suitable materials for the medium 44 include essentially any air-permeable synthetic or natural materials that exhibit the required filtration efficiencies, flame resistance, recoverability, and other requirements known in the art, such as operating temperature as defined by the specific application. In practice, the filtration unit 42 may be an existing commercial product, such as the TRIVENT® Series P04 or P06 filters manufactured by Endustra Filter Manufacturers, Inc., or any other inlet filtration device suitable for the particular application and capable of being coupled to the silencer housing 12. The filtration unit 42 could also be mounted directly to the silencer housing 12, instead of the inlet 16 on the housing 12, necessitating that the outlet 18 be removable to provide access to the removable, disposable, silencer cartridge unit 14 within the housing 12.

Figure 8:
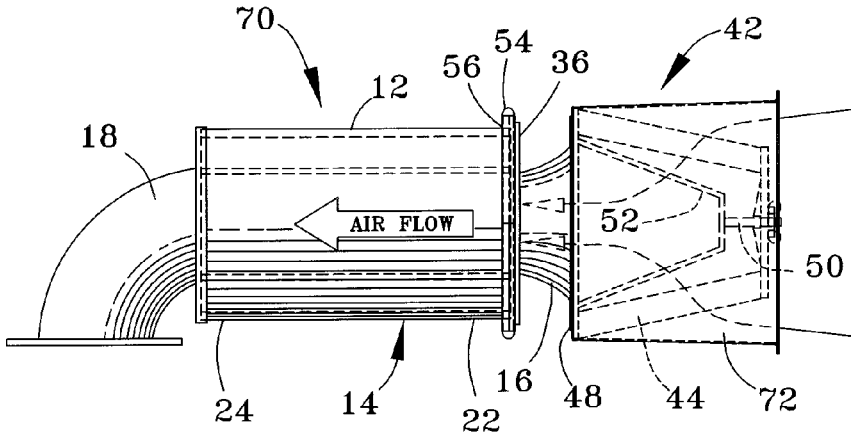
Figure 9:
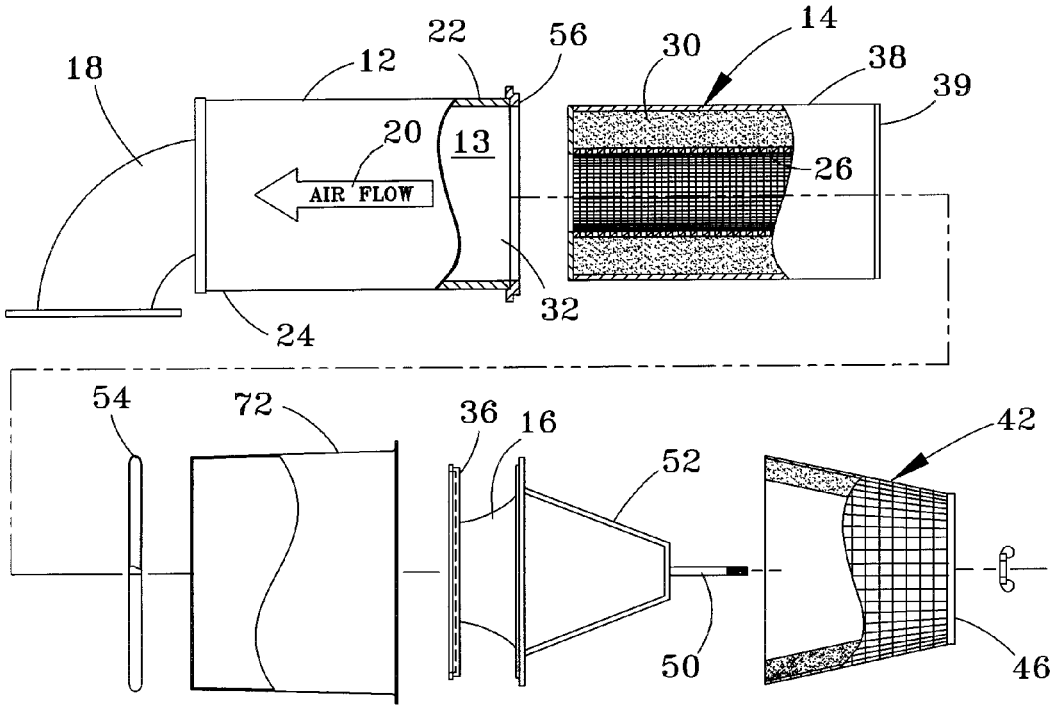

FIGS. 6 through 9 represent other filter-silencer apparatuses 60 and 70 similar to the apparatus 40 of FIGS. 4 and 5, but with their outlets 18 formed to have a ninety-degree bend to adapt the apparatuses 60 and 70 to other types of installations. As before, the rim 36 and its inlet 16 define a removable closure for the housing 12. In FIGS. 8 and 9, the filtration unit 42 further includes a weather hood (lid) 72 that surrounds the filtration medium 44, but is otherwise identical to the apparatus 60 of FIGS. 6 and 7.

Figure 10:
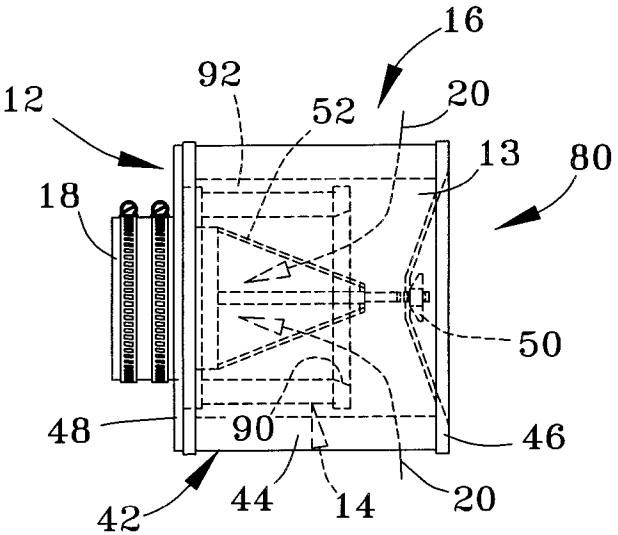
FIG. 10 is a partial cross-sectional representation of a silencer apparatus in accordance with another embodiment of the invention, in which the apparatus incorporates an integral filtration unit and the silencer cartridge unit is within the filtration unit.
Figure 11:
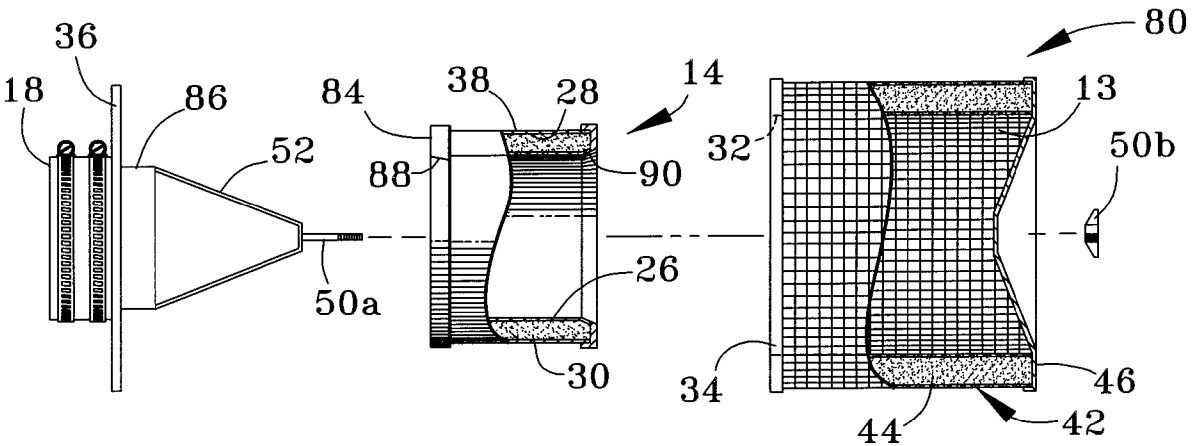
FIG. 11 is an exploded view of the apparatus of FIG. 10.

FIGS. 10 and 11 depict another configuration for a filter-silencer apparatus 80, in which the filtration unit 42 is incorporated directly into the silencer housing 12 and surrounds the silencer cartridge unit 14. The apparatus 80 is very compact and therefore advantageous for use in applications where space is limited or might not otherwise accommodate a conventional silencer or one of the silencer apparatuses of FIGS. 1 through 9.

As in the previous embodiments, the silencer housing 12 has a tubular shape and the silencer cartridge unit 14 is contained within a cavity 13 of the housing and is essentially coaxial with the housing 12. In contrast to previous embodiments, the housing 12 is defined by the filtration unit 42 and a plate 36 in which the outlet 18 (shown equipped with hose clamps) is provided, and the filtration unit 42 entirely surrounds the silencer cartridge unit 14. Instead of the inlet 16 to the housing 12 being formed by a pipe section and rim as shown in FIGS. 4 and 5, the inlet 16 is defined by the entire cylindrical-shaped outer periphery of the housing 12, at which the filtration medium 44 of the filtration unit 42 is installed. The filtration unit 42 is secured to the plate 36 with a fastening system 50 that includes a threaded rod 50A that passes through an opening in a closed end cap 46 of the filtration unit 42, and a nut 50B threaded onto the rod 50A. The rod 50A is mounted to a bracket 52 attached to the plate 36. The end 34 of the filtration unit 42 opposite the end cap 46 defines an opening 32 surrounded by a gasket, molded rubber or plastic, or other sealing means to enable the filtration unit 42 to create an airtight seal against the plate 36 via the pressure exerted via the fastening system 50. Though not shown as being hooded, the filtration unit 42 could further include a weather hood, such as the hood 72 shown in FIGS. 8 and 9.

The fastener system 50 may also be used to secure the silencer cartridge unit 14 within the housing 12. However, in a preferred embodiment, a fastener system is not required to secure the silencer cartridge unit 14 within the housing 12. Instead, the cartridge unit 14 is constructed to have an annular-shaped base 84 that fits over a tubular seating ring 86 on the plate 36 and surrounding the outlet 18. The base 84 comprises a molded rubber or plastic that is pliable and resilient and defines a circumferentially-tapered opening 88 of appropriate size so that as the cartridge unit 14 is manually forced down over the seating ring 86, the base 84 gradually applies increasing pressure on the seating ring 86 until the base 84 sufficiently deforms around the seating ring 86 to create a secure interference fit. The cartridge unit 14 can be removed by reversing this process. Other methods of seating the cartridge unit 14 could be employed, including but not be limited to clamps, fasteners, NPT connections, twist-locks, or other commonly known methods of fixing and seating annular devices.

In the case of the apparatus 80 depicted in FIGS. 10 and 11, the outer wall 38 of the silencer cartridge unit 14 must be impermeable, acting as a noise barrier. Air is drawn through the filtration medium 44, directed up through an annular-shaped channel 92 between the medium 44 and the outer wall 38 of the cartridge unit 14, over the outer wall 38 of the cartridge unit 14, and finally into the interior of the cartridge unit 14 through an opening 90 at an annular-shaped end of the unit 14 oppositely disposed from the base 84. The opening 90 is tapered to significantly reduce noise and restriction by creating an aerodynamic sloping surface with a low coefficient of drag over which the air travels. The redirection of airflow through the channel 92 and over the outer wall 38, and the interruption of the sound waves, reactively suppresses noise. Once the airflow passes into the silencer cartridge 14, the permeable inner core 26 allows sound energy to be absorbed by the absorptive media 30, where it is converted to thermal energy.

Though differing in its configuration, the filter-silencer apparatus 80 of FIGS. 10 and 11 still provides the advantage of a unitary and disposable silencer cartridge unit 14 that can be readily installed and removed through the opening 32 in the filtration unit 42, which is made accessible by detaching a removable closure (the plate 36) of the housing 12.

While the invention has been described in terms of a preferred embodiment, it is apparent that other forms could be adopted by one skilled in the art. For example, the physical configuration of the filtration system could differ from that shown, and materials other than those noted could be use. Therefore, the scope of the invention is to be limited only by the following claims.

The invention claimed is:

1. A silencer apparatus for attenuating sound propagated through a flowing gas from a noise source, the silencer apparatus comprising:

a housing having an interior cavity and a gas flow inlet and outlet that are adapted to be connected to a passage such that a gas flowing through the passage enters and exits the interior cavity of the housing through the inlet and outlet, respectively;

a silencer cartridge unit removably disposed within the interior cavity of the housing and defining first and second openings fluidically connected to the inlet and the outlet of the housing and through which the flowing gas is able to enter and exit, respectively, the silencer cartridge unit, the first and second openings of the silencer cartridge unit being aligned with the inlet and outlet of the housing to define therewith a gas flow path throughout the housing and the silencer cartridge unit, wherein airflow within the gas flow path is not restricted because the gas flow path has a substantially constant cross-sectional area, the silencer cartridge unit comprising a unitary assembly having first and second walls that define an enclosure surrounding the gas flow path and at least one sound-attenuating means surrounding the gas flow path, one of the first and second walls being a noise barrier and another of the first and second walls enabling sound energy to enter the enclosure from the gas flow path, the sound-attenuating means comprising means within the enclosure for absorbing and converting to thermal energy at least a portion of the sound energy that enters the enclosure through the second wall; and a closure sealingly closing a portion of the housing, the closure being releasable from the housing so as to provide an access opening in the housing through which the silencer cartridge unit in its entirety, including the unitary assembly, the first and second walls, the enclosure, and the sound-attenuating means thereof, can be removed from the housing without dismantling the silencer cartridge unit and can be replaced with a second silencer cartridge unit to maintain the performance of the silencer apparatus and protect downstream equipment from damage.

2. The silencer apparatus according to claim 1, wherein one of the inlet and outlet of the housing is disposed in the closure.

3. The silencer apparatus according to claim 1, wherein the inlet of the housing is disposed in the closure.

4. The silencer apparatus according to claim 1, wherein the first wall is the noise barrier and surrounds the second wall, the second wall is permeable to enable sound energy to enter the enclosure from the gas flow path, and the noise barrier interrupts sound waves that enter the enclosure but are not converted to thermal energy by the absorbing and converting means.

5. The silencer apparatus according to claim 4, wherein the absorbing and converting means is an absorptive material that defines a fibrous or porous mass, has an annular shape, and surrounds the gas flow path.

6. The silencer apparatus according to claim 5, wherein:

the first wall is an outer tubular member;

the second wall is an air-permeable tubular member within, attached to, and concentric with the outer tubular member and surrounds the gas flow path; and the enclosure is an annular-shaped enclosure between the outer tubular member and the air-permeable tubular member, the absorptive material being disposed within the annular-shaped enclosure.

7. The silencer apparatus according to claim 1, wherein the first wall is the noise barrier and interrupts sound waves prior to entering the enclosure.

8. The silencer apparatus according to claim 7, wherein the first wall is an outer tubular member, the second wall is an air-permeable inner tubular member attached to and concentric with the outer tubular member and surrounds the gas flow path, and the enclosure is an annular-shaped enclosure between the inner and outer tubular members.

9. The silencer apparatus according to claim 1, wherein the sound-attenuating means further comprises at least one reactive element.

10. The silencer apparatus according to claim 1, wherein the closure comprises a seating ring, and the silencer cartridge unit comprises means for resiliently securing the silencer cartridge unit to the seating ring by an interference fit with the seating ring.

11. The silencer apparatus according to claim 1, wherein the housing and the silencer cartridge unit have complementary tubular shapes and the silencer cartridge unit is concentrically disposed within the housing.

12. The silencer apparatus according to claim 11, wherein the inlet and the outlet of the housing are at oppositely-disposed longitudinal ends of the housing.

13. The silencer apparatus according to claim 1, further comprising a filtration unit with a filtration medium enclosed therein, the housing and the filtration unit being coupled together so that gas flowing through the housing also flows through the filtration unit and the filtration medium.

14. The silencer apparatus according to claim 13, wherein the filtration unit is exterior of the housing.

15. The silencer apparatus according to claim 13, wherein the filtration unit is coupled to the housing with the closure.

16. The silencer apparatus according to claim 15, wherein one of the inlet and outlet of the housing is disposed in the closure.

17. The silencer apparatus according to claim 15, wherein the inlet of the housing is disposed in the closure.

18. The silencer apparatus according to claim 1, wherein the housing comprises a filtration medium and the housing and the filtration medium are configured so that gas flowing through the housing also flows through the filtration medium.

19. The silencer apparatus according to claim 18, wherein the closure comprises a seating ring, and the silencer cartridge unit comprises resilient means that surrounds the second opening and secures the silencer cartridge unit to the seating ring by an interference fit with the seating ring.

20. The silencer apparatus according to claim 18, wherein the silencer cartridge unit is surrounded by the filtration medium.

* * * * *